US009779872B2

(12) United States Patent
Gerling

(10) Patent No.: US 9,779,872 B2
(45) Date of Patent: Oct. 3, 2017

(54) APPARATUS AND METHOD FOR FINE-TUNING MAGNET ARRAYS WITH LOCALIZED ENERGY DELIVERY

(71) Applicant: KLA-Tencor Corporation, Milpitas, CA (US)

(72) Inventor: John Gerling, Livermore, CA (US)

(73) Assignee: KLA-Tencor Corporation, Milpitas, CA (US)

( * ) Notice: Subject to any disclaimer, the term of this patent is extended or adjusted under 35 U.S.C. 154(b) by 317 days.

(21) Appl. No.: 14/565,166

(22) Filed: Dec. 9, 2014

(65) Prior Publication Data

US 2015/0179327 A1 Jun. 25, 2015

Related U.S. Application Data

(60) Provisional application No. 61/920,461, filed on Dec. 23, 2013.

(51) Int. Cl.
*H01F 13/00* (2006.01)
*H01F 41/02* (2006.01)

(52) U.S. Cl.
CPC ..... *H01F 41/0286* (2013.01)

(58) Field of Classification Search
CPC ..... G01D 5/145; G01D 5/147; G01R 33/09; G01R 33/093; G01B 7/003; H01F 41/0286; H01F 13/00
See application file for complete search history.

(56) References Cited

U.S. PATENT DOCUMENTS 5,283,130 A * 2/1994 Bradley ..... G06K 1/125 428/537.5
5,384,156 A * 1/1995 Belt ..... H01F 10/245 427/127

(Continued)

FOREIGN PATENT DOCUMENTS

EP 0 620 583 B1 6/1997
EP 0620583 6/1997

(Continued)

OTHER PUBLICATIONS

M. Forst, et al "Driving magnetic order in a manganite by ultrafast lattice excitation", Dec. 2, 2011, 2 sheets retrieved from the internet: http://prb.aps.org/abstract/PRB/v84/i24/e241104.

(Continued)

*Primary Examiner* — Jermele M Hollington
*Assistant Examiner* — Suresh K Rajaputra
(74) *Attorney, Agent, or Firm* — Okamoto & Benedicto LLP

(57) ABSTRACT

One embodiment relates to an apparatus for adjustment of local magnetic strength in a magnetic device. A stage holds the magnetic device, and a sensor measures a magnetic field at locations above the magnetic device so as to generate magnetic field data. A computer system detects a non-uniformity in the magnetic field from the magnetic field data and determines a location and a duration for application of a pulsed laser beam to correct the non-uniformity. A laser device applies the pulsed laser beam at said location for said duration. Another embodiment relates to a method of adjusting local magnetic strength in a magnetic device. Another embodiment relates to a system for fine-tuning a magnet array with localized energy delivery. Other embodiments, aspects and features are also disclosed.

20 Claims, 3 Drawing Sheets

(56) References Cited

U.S. PATENT DOCUMENTS

| | | | | |
|---|---|---|---|---|
| 5,601,662 | A * | 2/1997 | Hirai | G01L 3/102 148/100 |
| 5,663,609 | A * | 9/1997 | Kamohara | H01J 29/62 313/412 |
| 6,377,414 | B1 * | 4/2002 | Wang | B82Y 10/00 360/131 |
| 6,410,923 | B1 * | 6/2002 | Crewe | H01J 37/1416 250/396 ML |
| 6,781,370 | B1 * | 8/2004 | Hinken | G01N 25/72 324/224 |
| 8,299,713 | B2 | 10/2012 | Gonsalves et al. | |
| 2002/0033695 | A1 * | 3/2002 | Xiao | B82Y 35/00 324/244 |
| 2002/0140535 | A1 * | 10/2002 | Neuberth | H01F 7/0278 335/302 |
| 2005/0121429 | A1 * | 6/2005 | Liao | B23K 26/10 219/121.78 |
| 2005/0286607 | A1 | 12/2005 | Kim et al. | |
| 2010/0026284 | A1 | 2/2010 | Ante et al. | |
| 2010/0205699 | A1 * | 8/2010 | Tachizaki | B82Y 15/00 850/47 |
| 2011/0025221 | A1 | 2/2011 | Matsumoto et al. | |
| 2012/0235036 | A1 * | 9/2012 | Hatakeyama | G01N 23/2251 250/310 |
| 2013/0300040 | A1 * | 11/2013 | Moffatt | C21D 9/0006 266/249 |
| 2014/0218503 | A1 * | 8/2014 | Gerling | G01B 7/28 348/92 |
| 2016/0225523 | A1 * | 8/2016 | Danieli | G01R 33/3873 |

FOREIGN PATENT DOCUMENTS

| | | | | |
|---|---|---|---|---|
| EP | 1 743 209 | A | 10/2005 | |
| EP | 1743209 | | 1/2007 | |
| EP | 2 461 942 | A | 2/2011 | |
| EP | 2461942 | | 6/2012 | |
| JP | 01-124204 | | 5/1989 | |
| WO | WO 2005/101103 | A1 | 10/2005 | |
| WO | WO 2011/017266 | A1 | 2/2011 | |
| WO | WO 2015043684 | A1 * | 4/2015 | G01R 33/3873 |

OTHER PUBLICATIONS

Mike Ross "Shaken, Not Heated: the Ideal Recipe for Manipulating Magnetism", Jan. 31, 2012, 1 sheet, retrieved from the internet: https://www6.slac.stanford.edu/news/2012-01-31-shaken-not-heated-the-ideal-recipe-for-manipulating.aspx.

International Search Report for Application No. PCT/US2014/070672, Mar. 31, 2015 (Mar. 31, 2015), 3 sheets.

Mike Ross "Shaken, Not Heated: the Ideal Recipe for Manipulating Magnetism", Jan. 31, 2012, 1 sheet, SLAC National Accelarator Laboratory [retrieved on May 13, 2014], retrieved from the internet: https://www6.slac.stanford.edu/news/2012-01-31-shaken-not-heated-the-ideal-recipe-for-manipulating.aspx.

M. Forst, et al., "Driving magnetic order in a manganite by ultrafast lattice excitation", Dec. 2, 2011, 5 sheets, Physical Review B 84, American Physical Society.

* cited by examiner

200

300

APPARATUS AND METHOD FOR FINE-TUNING MAGNET ARRAYS WITH LOCALIZED ENERGY DELIVERY

CROSS-REFERENCE TO RELATED APPLICATION(S)

The present application claims the benefit of U.S. Provisional Patent Application No. 61/920,461, inventor John Gerling, filed Dec. 23, 2013, the disclosure of which is hereby incorporated by reference.

BACKGROUND OF THE INVENTION

Technical Field

The present disclosure relates to magnetic structures. More particularly, the present disclosure relates to adjusting the strength of a magnetic apparatus.

Description of the Background Art

A conventional technique for adjusting the strength of a magnet involves controlling a temperature of the magnet. For example, a temperature-controlled chuck may be used to heat a magnet array in a controllable manner. By adjusting the temperature of the array, the strength of the entire magnet array may be adjusted at the same time.

SUMMARY

One embodiment relates to an apparatus for adjustment of local magnetic strength in a magnetic device. A stage holds the magnetic device, and a sensor measures a magnetic field at locations above the magnetic device so as to generate magnetic field data. A computer system detects a non-uniformity in the magnetic field from the magnetic field data and determines a location and a duration for application of a pulsed laser beam to correct the non-uniformity. A laser device applies the pulsed laser beam at said location for said duration.

Another embodiment relates to a method of adjusting local magnetic strength in a magnetic device. Steps of the method include: holding the magnetic device using a translatable stage; measuring a magnetic field using a sensor at locations above the magnetic device so as to generate magnetic field data; detecting a deviation in the magnetic field from the magnetic field data; determining a location and a duration for application of a pulsed laser beam to correct the deviation; and applying the pulsed laser beam at said location for said duration for adjustment of the local magnetic strength.

Another embodiment relates to a system for fine-tuning a magnet array with localized energy delivery. The system may be automated. The system includes: a translatable stage for holding and translating the magnet array; an inspection microscope for aligning a position of the magnet array; a sensor that measures a magnetic field at locations above the magnet array so as to generate magnetic field data; a computer apparatus that detects a deviation in the magnetic field from the magnetic field data; and a laser device that applies the pulsed laser beam to correct the deviation.

Other embodiments, aspects and features are also disclosed.

DETAILED DESCRIPTION

The present disclosure provides an innovative technique that does not use temperature control for adjusting local magnetic strength in a magnetic device. Rather, the technique uses laser pulses of a specific wavelength to provide targeted energy delivery. The targeted energy delivery effectively excites and/or distorts the lattice structure of the material to quench or reduce magnetism in the local vicinity of the delivered energy.

In one implementation, the wavelength may be related to absorption properties of the target magnetic material. The laser pulses may be of ultra-short duration to avoid excessive heating of the work piece that may adversely affect non-targeted magnetic domains. For example, research has found that, to adjust manganite material, the laser pulses may have a frequency above a terahertz and aduration on the order of 100 femtoseconds long.

In accordance with an embodiment of the invention, the presently-disclosed technique may be used in the manufacturing process for constructing a magnetic lens array. Using this technique, the magnetic lens array may be constructed to meet specifications so as to be used as a high-performance passive electron-optic element.

Meeting such specifications is difficult using conventional manufacturing processes because there are many sources that can introduce non-uniformity into the array. For example, machining tolerances may be not met, or there may be non-uniformities in the properties of the raw material, or there may be non-uniformity in the solenoid field used to charge the magnet array. In addition, it is often prohibitive to re-machine a magnetic part after magnetization of the part due to the difficult issue of removing magnetized particles.

The presently-disclosed technique provides for targeted delivery of light energy at a specified wavelength so as to adjust local magnetism without heating up the overall material of the work piece. By the local and direct application of energy to tune the magnetism of the work piece, this technique avoids issues relating to machining a magnetized part. By way of this technique, the peak field strengths and general lensing properties (such as astigmatism) may be adjusted to compensate for defects in the manufacturing process that may be unavoidable.

The magnetic lens array may be used, for example, as an electron-optics element in an electron beam column of an electron-beam imaging apparatus. The electron-beam imaging apparatus may be used, for example, for inspection and/or review of manufactured substrates. When peak field strength and/or astigmatism are corrected using the presently-disclosed technique, improved electron optics and imaging performance results.

Figure 1:
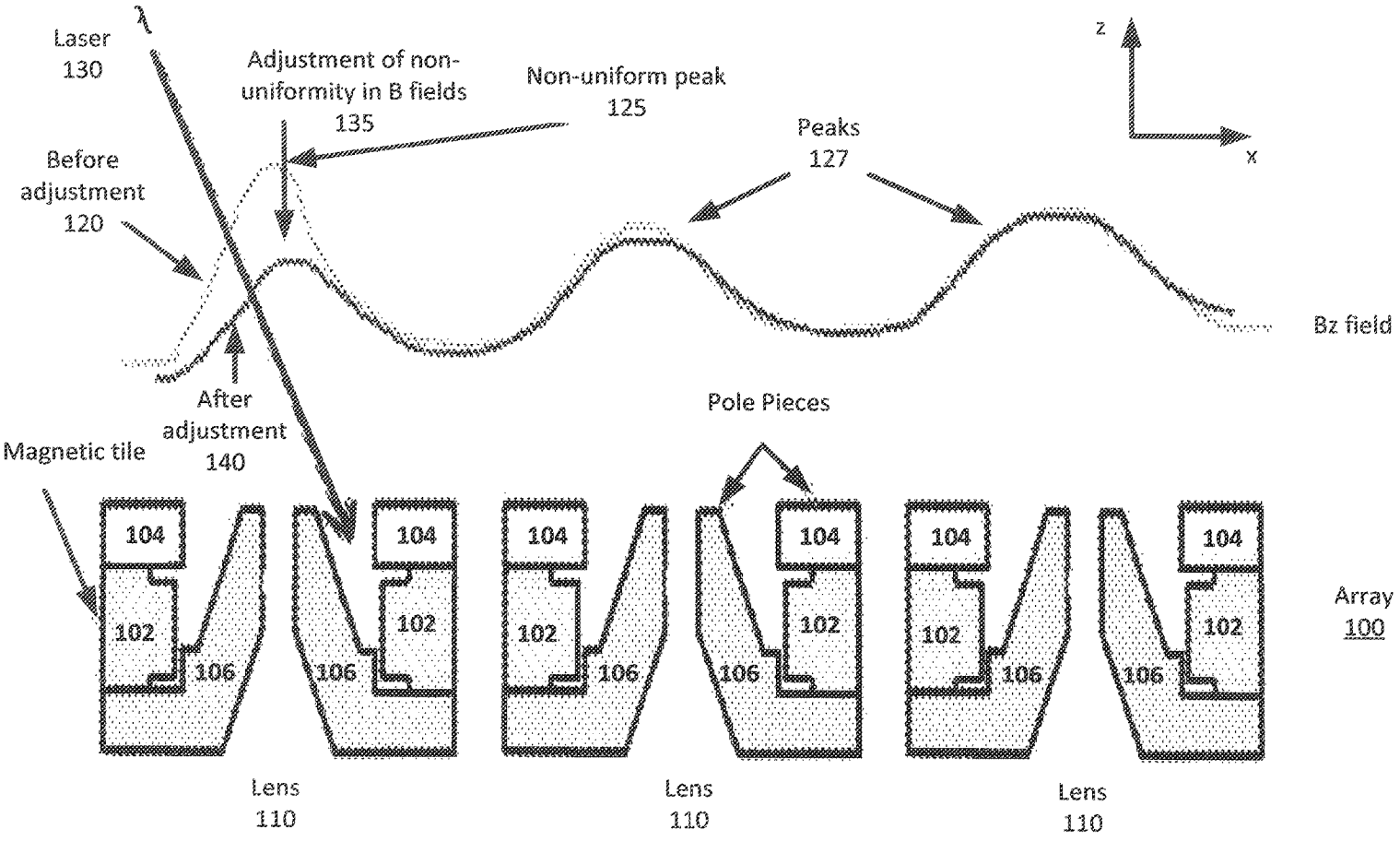
FIG. 1 is a schematic diagram showing an array of magnetic pole pieces with initial and adjusted magnetic field in accordance with an embodiment of the invention.

FIG. 1 is a schematic diagram showing an array of magnetic pole pieces 100 with initial and adjusted magnetic field in accordance with an embodiment of the invention. The array of magnetic pole pieces 100 is depicted in cross section and may include magnetic tiles 102 and pole pieces 104 and 106. The array 100 may include multiple magnetic lenses 110 spaced periodically along a direction (the x-direction in FIG. 1). In another embodiment, the array may be spaced periodically in two direction (both x and y directions). In other embodiments, the work piece may be a magnetic device that is not a periodic array. The array may generate a magnetic field. The magnetic field's z-direction component (Bz field) as a function of position in the x-dimension is shown in the graph above the array.

In this illustrative example, the Bz field is shown as may be measured before adjustment 120. As depicted, the Bz field before adjustment 120 is shown to have a non-uniform peak 125 due to one lens 110 that is substantially higher than the peaks 127 due to other lenses 110 in the array. This non-uniform peak 125 indicates a non-uniformity in the corresponding lens 110 that may be corrected in accordance with an embodiment of the invention.

As further depicted, the non-uniform peak 125 may be shifted to one side of the expected location of the peak. A pulsed laser beam 130 of wavelength λ may be directed to a section of the corresponding lens 110 so as to make an adjustment 135 to the non-uniformity of the magnetic (B) fields. The Bz field after the adjustment 140 so as to correct the non-uniformity is illustrated.

In the illustrated example, the non-uniform peak 125 is shifted to the left side compared with the expected position of the peak relative to the corresponding lens 110. In this case, the pulsed laser beam 130 of wavelength λ may be directed to a section on the right side of the corresponding lens 110 so as to correct the non-uniformity.

An exemplary apparatus for detecting and correcting non-uniformities of a magnetic device is described below in relation to FIG. 2. An exemplary procedure for detecting and correcting non-uniformities of a magnetic device is described below in relation to FIG. 3.

Figure 2:
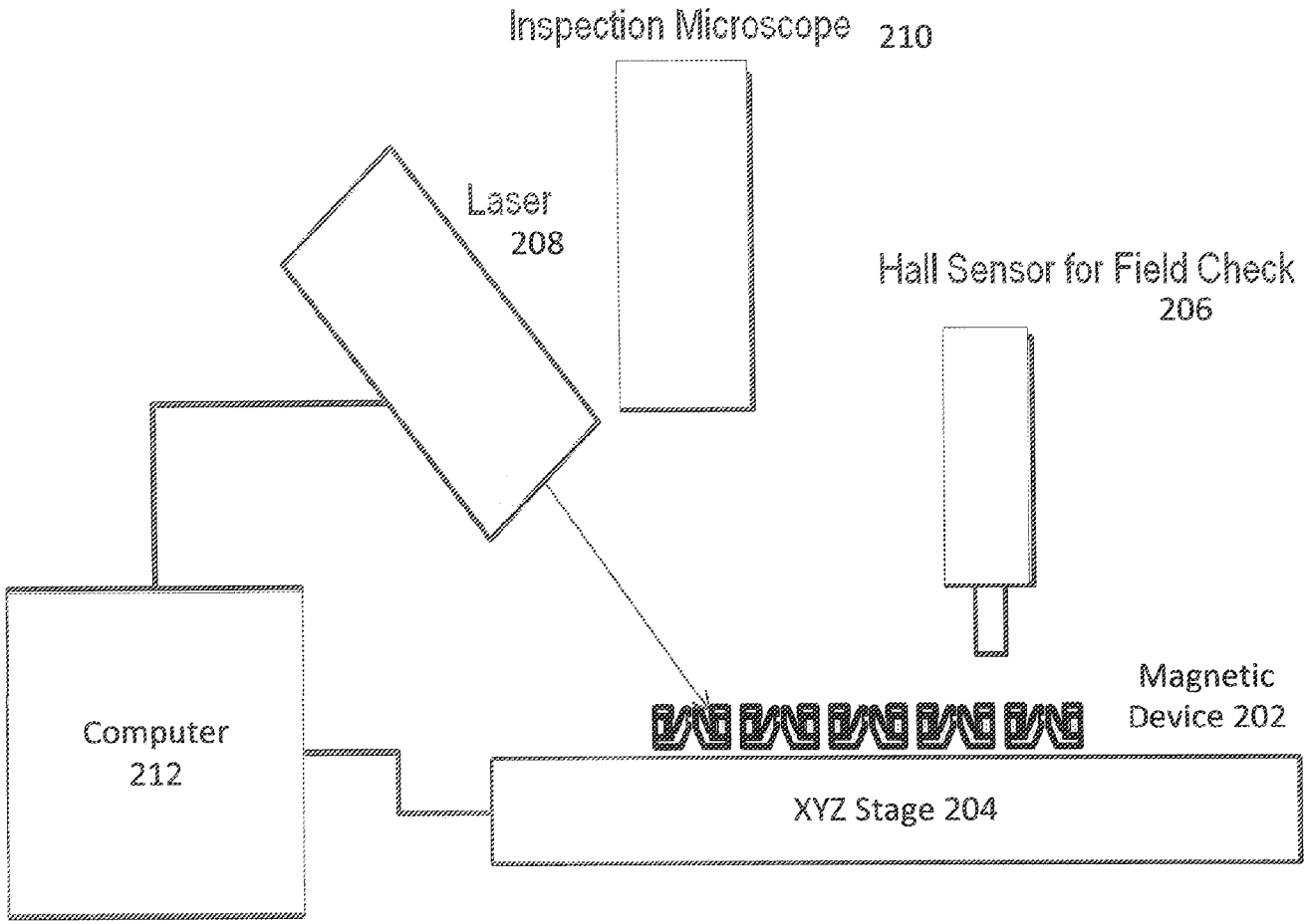
FIG. 2 depicts an apparatus for adjustment of local magnetic strength in a magnetic device in accordance with an embodiment of the invention.

FIG. 2 depicts an apparatus 200 for adjustment of local magnetic strength in a magnetic device 202 in accordance with an embodiment of the invention. The magnetic device 202 may be, for example, a magnet array 100 such as described above in relation to FIG. 1.

As depicted, the apparatus 200 may include an XYZ stage 204 that holds the magnetic device 202. The XYZ stage 204 may be used to move the magnetic device 202 in the x, y, or z directions under control of a computer apparatus 212. An inspection microscope 210, which may be an optical microscope, may be used to image the magnetic device 202 for alignment and visual inspection. The microscope may have various illumination capabilities, such as for bright field and dark field imaging, for example.

A Hall sensor 206 may be positioned above the magnetic device 202. The stage 204 may be translated in x, y, and/or z directions under the Hall sensor 206 so as to measure the magnetic field at different locations above the magnetic device 202. The inspection microscope 210 may be used for aligning the magnetic device 202 relative to the hall sensor 206. Measurement data from the Hall sensor 206 may be provided to the computer apparatus 212. In other embodiments, other types of magnetic sensors may be used, such as, for example, magnetoresistive sensors, giant magnetoresistive sensors, and magneto optical Kerr effect sensors.

A laser device 208 may be positioned such that a pulsed laser beam may be directed at the magnetic device 202. In one implementation, the laser device 208 may have a controllable orientation so as to controllably change an incident angle of the pulsed laser beam that is directed to the magnetic device 202. The stage 204 may be translated in x, y, and/or z directions under the laser device 208 so that the pulsed laser beam may be directed to a desired location on the magnetic device 202. The inspection microscope 210 may be used for aligning the magnetic device 202 relative to the laser device 208 and for targeting the pulsed laser beam onto a desired location on the magnetic device 202.

The targeted location at which the pulsed laser beam impinges upon the magnetic device 202 may be imaged and observed using the inspection microscope 210. The inspection microscope 210 may also be used to visually inspect the magnetic device 202 for observable defects.

Figure 3:
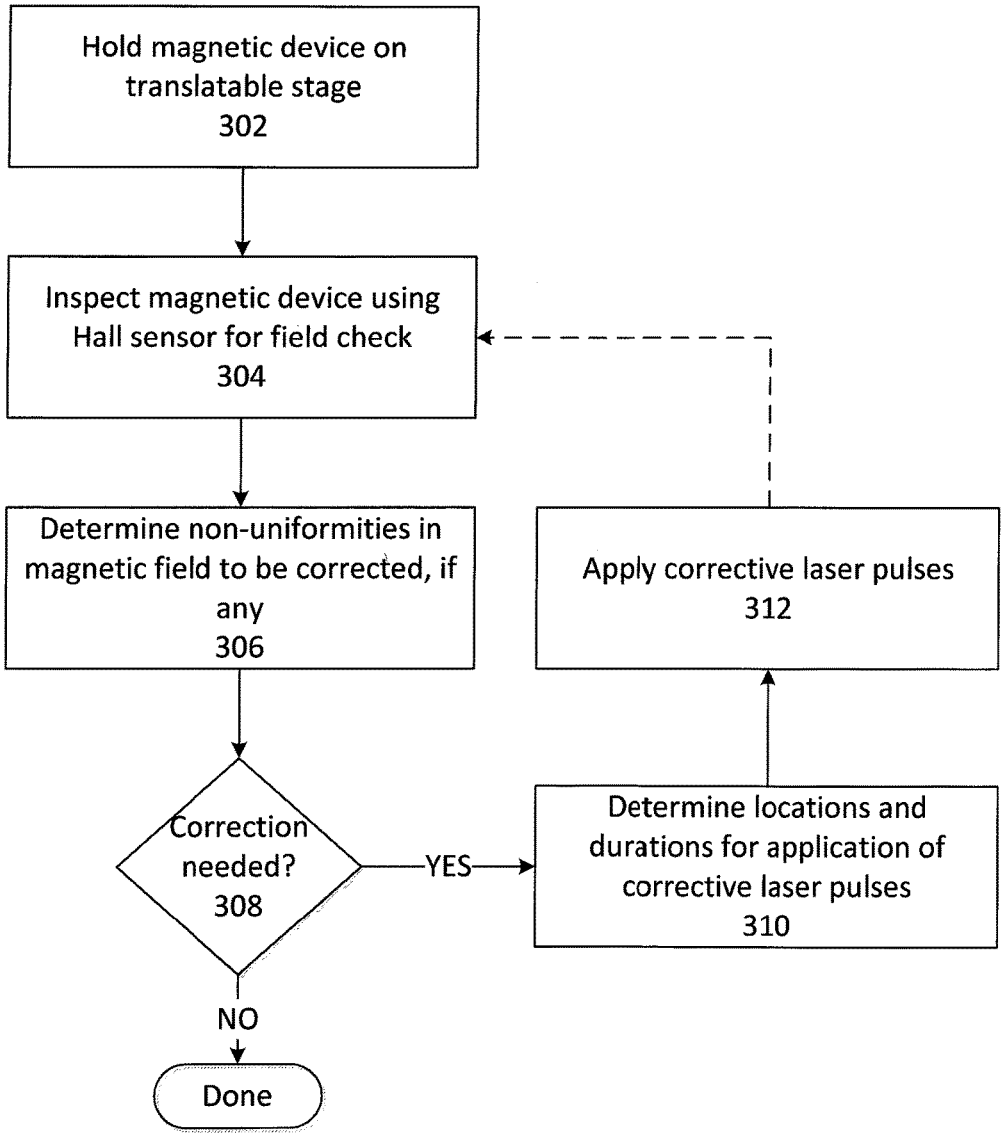
FIG. 3 is a flow chart showing a method of adjusting local magnetic strength in a magnetic device in accordance with an embodiment of the invention.

FIG. 3 is a flow chart showing a method 300 of adjusting local magnetic strength in a magnetic device 202 in accordance with an embodiment of the invention. The method 300 may be implementing, for example, using the apparatus 200 described above in relation to FIG. 2. The computer 212 in the apparatus 200 may be provided with a control module that is programmed to automate the method 300 so as to fine-tune the magnetic field generated by the magnetic device 202.

Per block 302, the magnetic device is held on a translatable stage. The magnetic device may be, for example, a magnet array 100 as described above. The stage may be, for example, an XYZ stage 204 as described above.

Per block 304, magnetic fields generated by the magnetic device may be measured. This step may involve using a Hall sensor (a sensor that uses the Hall effect) to measure the magnetic field at locations above the magnetic device. The magnetic device may be translated under the Hall sensor using the translatable stage, and the measurement data may be received, stored, and analyzed by a computer system.

Per block 306, a determination may be made of non-uniformities (i.e. deviations) in the magnetic field to be corrected, if any. This determination may be made by the computer system or by an operator using the computer system. An example of a non-uniformity needing correction is discussed above in relation to FIG. 1. For example, if the magnetic field deviates from the expected (uniform) field by more than a threshold field strength, then that deviation (non-uniformity) may be deemed as needing correction.

Per block 308, if it is determined that no non-uniformities need correction, then the method 300 may be done (complete). Otherwise, if it is determined that one or more non-uniformities need correction, then, per block 310, the method 300 may determine locations and durations for application of corrective laser pulses. This determination may be made by the computer system or by an operator using the computer system. For example, the location for application of corrective laser pulses may be determined from the location of the field non-uniformity, and the duration for application of corrective laser pulses at a particular location may be determined from the magnitude of the deviation needing correction.

Per block 312, corrective laser pulses may then be applied at the locations and for the durations determined in block 310. Thereafter, the method 300 may, optionally, loop back to block 304 and a further field check inspection may be performed so as to verify that the non-uniformity has been corrected or determine if any remaining non-uniformities still exist that need correction.

What is claimed is:

1. An apparatus for adjustment of local magnetic strength in a magnetic device, the apparatus comprising:

a stage for holding the magnetic device;

a sensor that measures a magnetic field at locations above the magnetic device so as to generate magnetic field data;

a computer system that detects a non-uniformity in the magnetic field from the magnetic field data, wherein the non-uniformity comprises a shift in a position of a peak in the magnetic field, and determines a location and a duration for application of a pulsed laser beam to correct the non-uniformity; and a laser device that applies the pulsed laser beam at a section on one side of the peak for said duration to correct the position of the peak.

2. The apparatus of claim 1, wherein the stage comprises a translatable stage that is controlled by the computer system.

3. The apparatus of claim 2, wherein translatable stage controllably moves the magnetic device in three dimensions.

4. The apparatus of claim 1, wherein the sensor comprises a Hall sensor that measures the magnetic field using the Hall effect.

5. The apparatus of claim 1, wherein the sensor comprises a magnetoresistive sensor.

6. The apparatus of claim 1, wherein the sensor comprises a giant magnetoresistive sensor.

7. The apparatus of claim 1, wherein the sensor comprises a magneto optical Kerr effect sensor.

8. The apparatus of claim 1, wherein non-uniformities in the magnetic field comprise deviations from an expected magnetic field.

9. The apparatus of claim 1, wherein the laser device has a controllable orientation so as to controllably change an incident angle of the pulsed laser beam onto the magnetic device.

10. The apparatus of claim 1, further comprising:

an inspection microscope for aligning the magnetic device for targeted application of the pulsed laser beam.

11. The apparatus of claim 10, wherein the inspection microscope comprises an optical microscope.

12. The apparatus of claim 1, wherein the magnetic device comprises a magnetic lens, and wherein the non-uniformity causes astigmatism of the magnetic lens.

13. A method of adjusting local magnetic strength in a magnetic device, the method comprising:

holding the magnetic device using a translatable stage;

measuring a magnetic field using a sensor at locations above the magnetic device so as to generate magnetic field data;

detecting a deviation in the magnetic field from the magnetic field data, wherein the deviation comprises a shift in a position of a peak in the magnetic field;

determining a location and a duration for application of a pulsed laser beam to correct the deviation; and applying the pulsed laser beam at a section on one side of the peak for said duration for adjustment of the local magnetic strength to correct the position of the peak.

14. The method of claim 13, further comprising:

measuring the magnetic field using the sensor after said applying to check a result of said adjustment of the local magnetic strength.

15. The method of claim 14, further comprising:

detecting a remaining deviation in the magnetic field from said check;

determining a second location and a second duration for application of the pulsed laser beam to correct the remaining deviation; and applying the pulsed laser beam at said second location for said second duration for further adjustment of the local magnetic strength.

16. A system for fine-tuning a magnet array with localized energy delivery, the system comprising:

a translatable stage for holding and translating the magnet array;

an inspection microscope for aligning a position of the magnet array;

a sensor that measures a magnetic field at locations above the magnet array so as to generate magnetic field data;

a computer apparatus that detects a deviation in the magnetic field from the magnetic field data, wherein the deviation comprises a shift in a position of a peak in the magnetic field; and a laser device that applies the pulsed laser beam a section on one side of the peak to correct the position of the peak.

17. The system of claim 16, wherein the magnet array comprises an array of magnetic lenses.

18. The system of claim 17, wherein the deviation causes astigmatism or variation in peak strength in focusing of a magnetic lens of the array.

19. The system of claim 16, wherein the system is automated under control of the computer apparatus so as to fine-tune the magnetic field generated by the magnet array.

20. The system of claim 19, wherein a control module of the computer apparatus is configured to perform steps comprising:

using the sensor and translation of the stage to measure the magnetic field at multiple locations above the magnet array so as to generate the magnetic field data;

detecting the deviation in the magnetic field from the magnetic field data;

determining a location and a duration for application of the pulsed laser beam to mitigate the deviation; and applying the pulsed laser beam at said location for said duration.

* * * * *